United States Patent [19]

Pettit

[11] Patent Number: 4,603,758

[45] Date of Patent: Aug. 5, 1986

[54] LADDER CONSTRUCTION

[76] Inventor: Frederick M. Pettit, 1411 Point Abino Rd. S., Ridgeway, Ontario, Canada, L0S 1N0

[21] Appl. No.: 688,766

[22] Filed: Jan. 4, 1985

[51] Int. Cl.[4] ..... E06C 7/08; E06C 9/02

[52] U.S. Cl. ..... 182/194; 182/106; 182/46; 182/111; 182/228

[58] Field of Search ..... 182/194, 93, 96, 106, 182/46, 228, 108, 111, 118

[56] References Cited

U.S. PATENT DOCUMENTS

| | | | |
|---|---|---|---|
| 3,428,147 | 2/1969 | Gordon | 182/204 |
| 3,586,124 | 6/1971 | Kunzweiler | 182/106 X |
| 3,944,024 | 3/1976 | Adas | 182/194 |
| 3,991,851 | 11/1976 | Gannon | 182/106 X |
| 4,023,647 | 5/1977 | Confer | 182/106 X |
| 4,151,895 | 5/1979 | Rasada, Jr. et al. | 182/194 X |
| 4,193,477 | 3/1980 | Broyles | 182/228 X |
| 4,199,040 | 4/1980 | Lapeyre | 182/106 X |

*Primary Examiner*—Ramon S. Britts
*Assistant Examiner*—Karen J. Chotkowski
*Attorney, Agent, or Firm*—Joseph P. Gastel

[57] ABSTRACT

A ladder consisting of a pair of spaced rails, a plurality of rungs having opposite end portions with first holes extending therethrough for receiving the rails in complementary mating relationship, first slots extending inwardly into the rungs from the bottom sides thereof and terminating at bearing areas which bear on the outer ends of first pins which are carried by the rails, and a pivotal rung-like base having end portions with second holes extending inwardly from the top side thereof for receiving the ends of the rails and second slots extending inwardly into the rung-like base from the top side thereof terminating at bearing surfaces which carry the load transmitted by the outer ends of second pins mounted on the lower ends of the rails.

13 Claims, 12 Drawing Figures

Fig. 8.
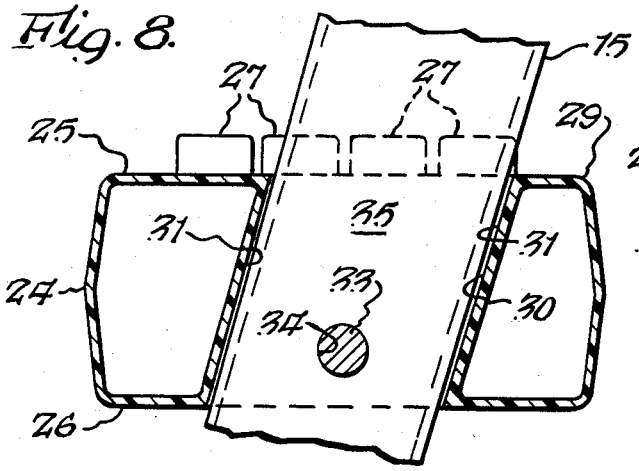
Fig. 9.
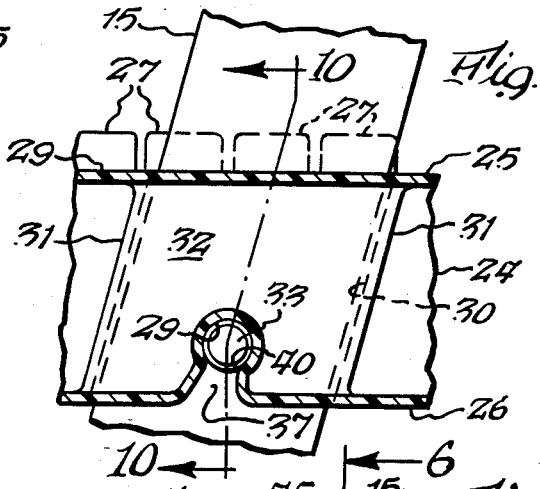
Fig. 4.
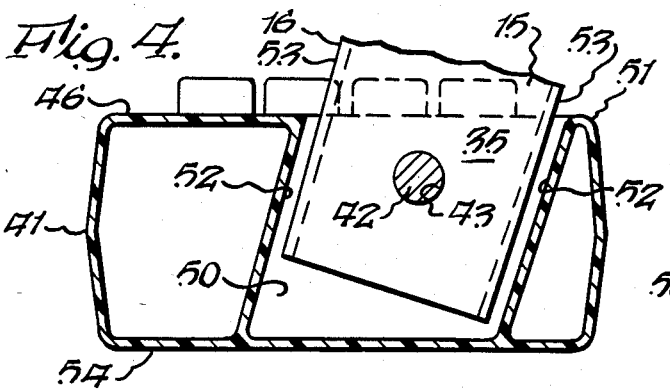
Fig. 5.
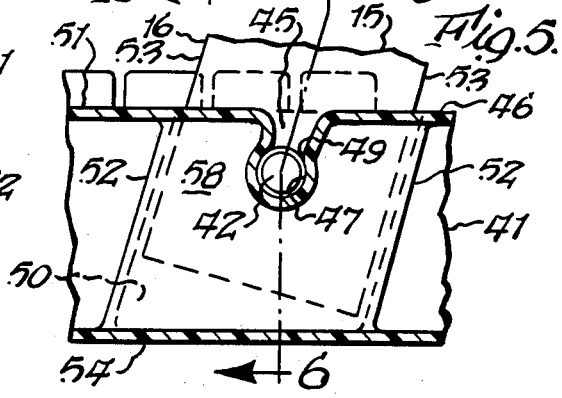
Fig. 6.
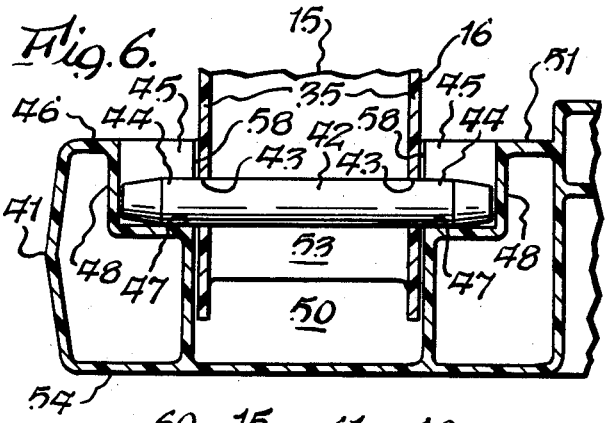
Fig. 10.
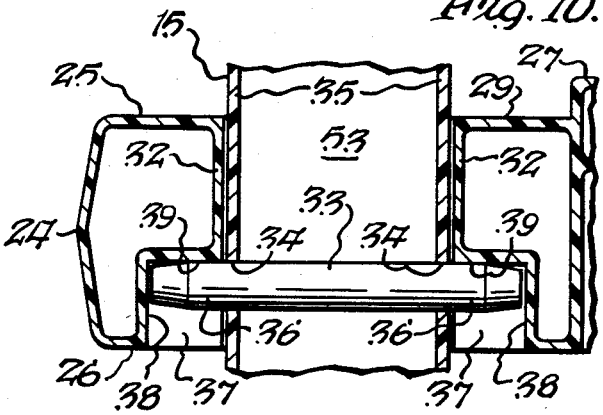
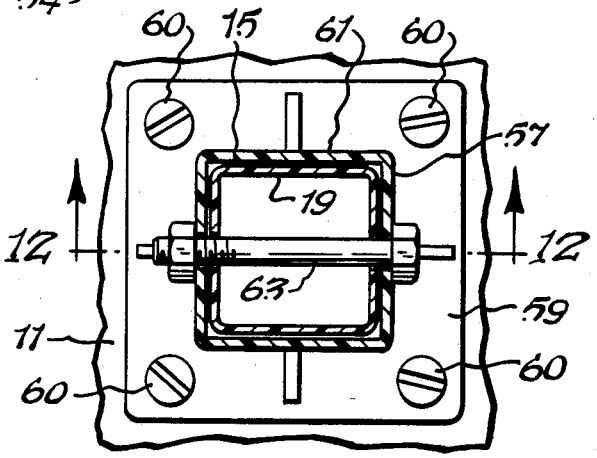
Fig. 11.
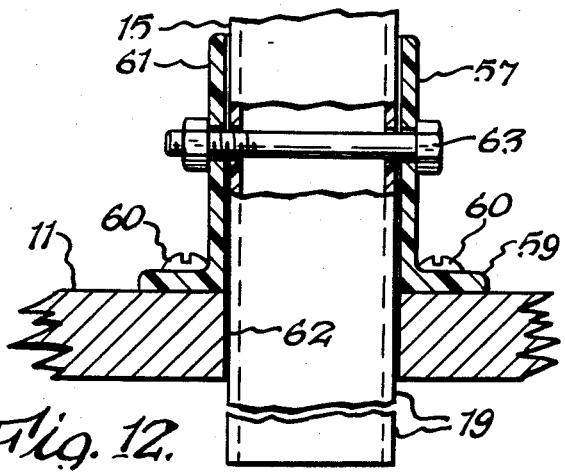
Fig. 12.

LADDER CONSTRUCTION

BACKGROUND OF THE INVENTION

The present invention relates to an improved ladder for use with swimming pools.

By way of background, in the past ladders used with swimming pools required tools and considerable effort to assemble them. In addition, the lower ends of prior pool ladders would only rest on the bottom of the pool if the bottom was perfectly level and the ladder was oriented plumb. With out-of-level pool bottoms or ladders which were not plumb, the base of the ladder would rest on an edge causing wear and possible puncture of the pool liner.

SUMMARY OF THE INVENTION

It is one object of the present invention to provide an improved ladder which can be assembled with little effort and without the use of tools.

Another object of the present invention is to provide an improved pool ladder having a pivotal lower rung-like base which will swivel to its best bearing relationship with the bottom of the pool on which it rests, thereby minimizing the tendency for it to cut through the pool liner. Other objects and attendant advantages of the present invention will readily be perceived hereafter.

The present invention relates to a ladder comprising a pair of spaced rails having upper and lower ends, a plurality of rungs between said upper and lower ends, means mounting said rungs on said spaced rails, a rung-like base having a longitudinal axis and opposite end portions and upper and lower sides, holes in said opposite end portions, pins having longitudinal axes extending through said lower ends of said rails in the direction of said longitudinal axis and having outer end portions extending beyond said rails, slot means in said end portions of said rung-like base extending outwardly from said holes and extending inwardly into said rung-like base from said upper side thereof and terminating at bearing areas within said rung-like base for receiving said outer end portions of said pins with said pins bearing on said bearing areas. The rungs for the ladder are mounted on the rails in substantially the same manner except that the pins are received in slots which extend inwardly into the rungs from lower surfaces thereof.

The various aspects of the present invention will be more fully understood when the following portions of the specification are read in conjunction with the accompanying drawings wherein:

BRIEF DESCRIPTION OF THE DRAWINGS

FIG. 4 is a fragmentary cross sectional view taken subtantially along line 4—4 of FIG. 3;

FIG. 5 is a fragmentary cross sectional view taken substantially along line 5—5 of FIG. 3 and showing primarily the slots in the rung-like base for receiving the pins at the lower ends of each rail;

FIG. 6 is a fragmentary cross sectional view taken substantially along line 6—6 of FIG. 5;

FIG. 8 is a fragmentary cross sectional view taken substantially along line 8—8 of FIG. 7;

FIG. 9 is a fragmentary cross sectional view taken substantially along line 9—9 of FIG. 7 and showing the attachment between the rungs and the rails;

FIG. 10 is a fragmentary cross sectional view taken substantially along line 10—10 of FIG. 9;

FIG. 11 is a fragmentary cross sectional view taken substantially along line 11—11 of FIG. 1 and showing the attachment between return bends of the rails and the pool deck; and FIG. 12 is a fragmentary cross sectional view taken substantially along line 12—12 of FIG. 11.

DESCRIPTION OF THE PREFERRED EMBODIMENTS

Figure 1:
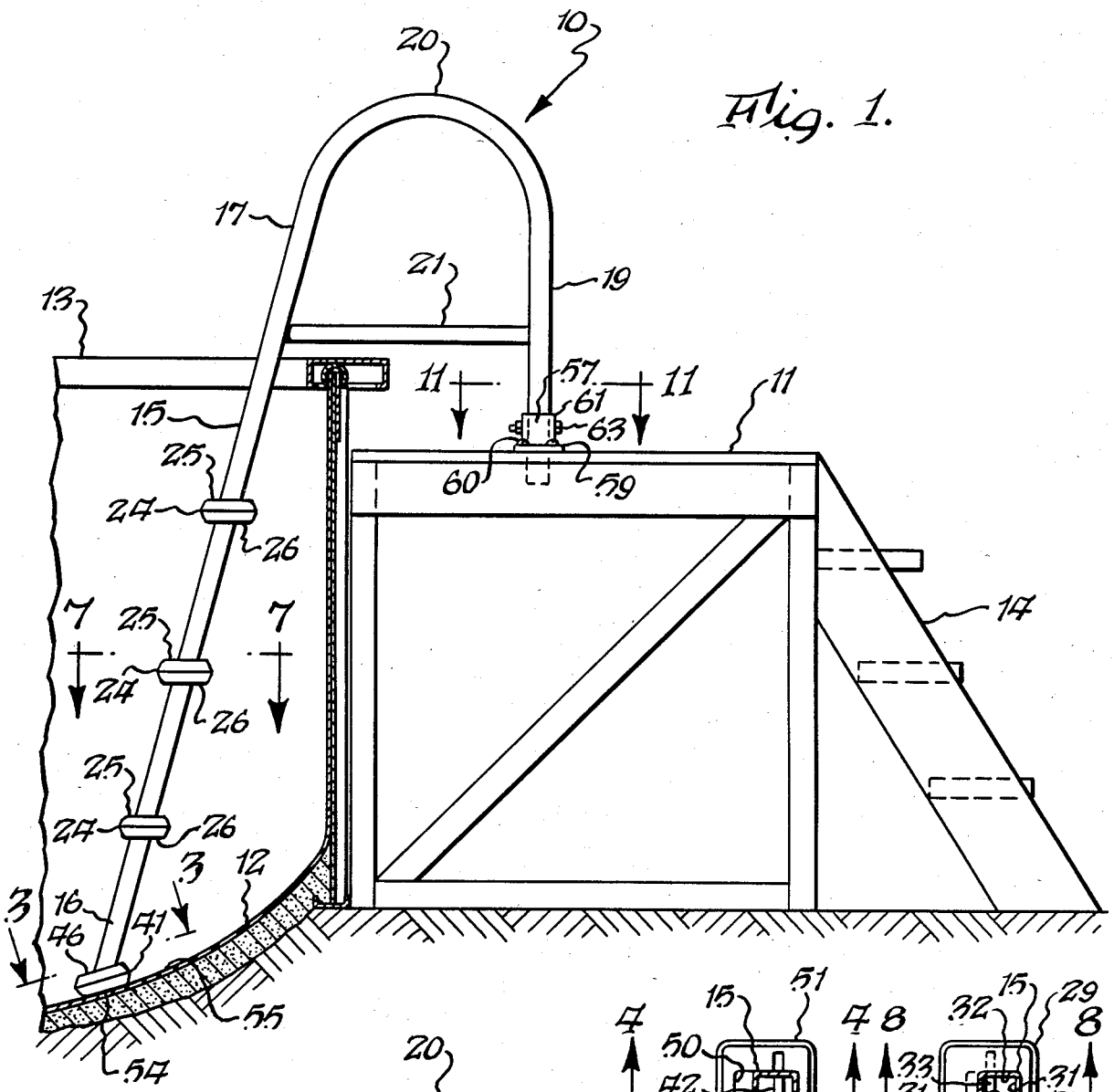
FIG. 1 is a fragmentary side elevational view of a swimming pool deck and swimming pool with the improved ladder of the present invention mounted relative thereto.

The improved ladder 10 of the present invention is shown in FIG. 1 mounted relative to the pool deck 11 and pool bottom 12 of swimming pool 13. Access to pool deck 11 is obtained by mounting steps 14 and entry and exit into pool 13 may be by the use of ladder 10.

Figure 2:
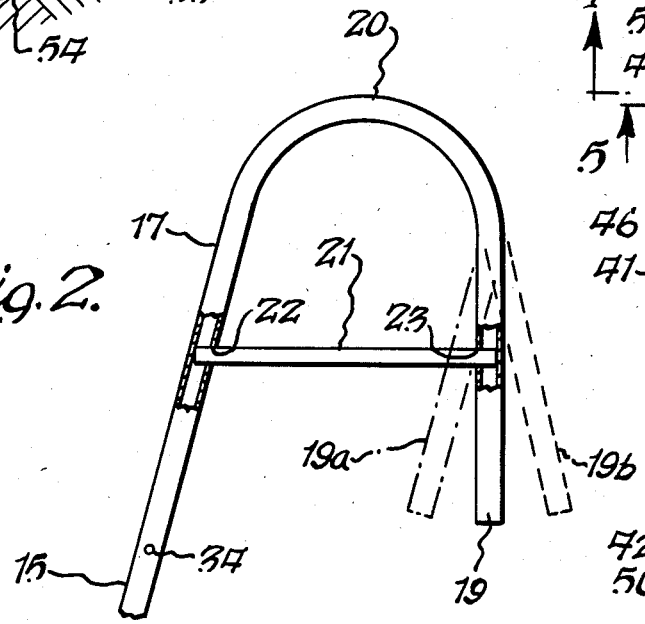
FIG. 2 is a fragmentary side elevational view, partially broken away, demonstrating the resilient nature of the return bend at the top of each rail.
Figure 3:
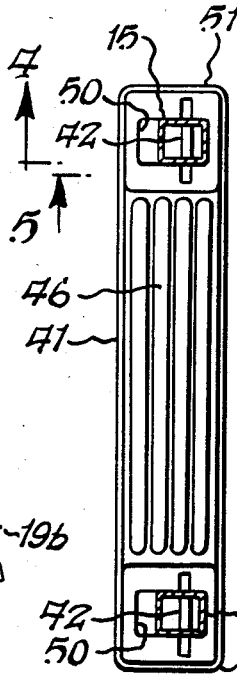
FIG. 3 is a cross sectional view taken substantially along line 3—3 of FIG. 1 and showing the rung-like base and its connection to the lower ends of the rails.
Figure 7:
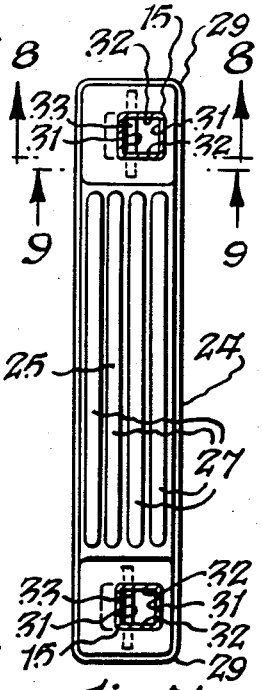
FIG. 7 is a cross sectional view taken substantially along line 7—7 of FIG. 1 and showing the relationship between the rungs and the rails.

Ladder 10 comprises a pair of spaced identical rails 15 which are shown as being quadrangular in cross section but which may be of any other desired shape. Rails 15, as shown, are tubular plastic members fabricated from polyvinyl chloride but they may be of metal if desired. Rails 15 have lower ends 16 and upper ends 17. A return bend 20 extends beyond upper end 17 and merges with downwardly extending leg 19. The leg 19 is originally formed in the position shown at **19*a* in FIG. 2. The return bend 20 is resilient so that leg 19 can be biased to the position 19*b* so that a rail strut 21 can be inserted into holes 22 and 23. When leg 19 is released, the resilience of return bend 20 will move leg 19 to the solid line position of FIG. 2 wherein the ends of rail strut 21 are retained within holes 22 and 23 and the ends of rail strut 21** bear against the inner surfaces of the tubular rails.

A plurality of rungs or steps 24 are mounted in spaced relationship on rails 15. Rungs 24 are blow-molded hollow plastic members having the shapes shown in FIGS. 1, 7, 8 and 9. Each rung 24 has an upper side 25 and a lower side 26. Suitable tread members 27 are located on upper side 25. Each rung 24 also has a central portion and integral outer end portions 29 which have through holes 30 having spaced pairs of side walls 31 and 32 which fit in complementary mating relationship with the outer surfaces of tubular rails 15 so as to cause upper surfaces 25 to be substantially horizontal when rails 15 are inclined as shown in FIGS. 1 and 8.

Each rung or step 24 is assembled with rails 15 by first sliding each rung 24 to a higher position than shown in FIG. 1. Thereafter, metal pins 33 (FIGS. 8, 9 and 10) are slipped through holes 34 in opposite side walls 35 of each rail 15 with the outer ends 36 of the pins protruding beyond side walls 35. Thereafter, each rung 24 is moved downwardly to the position shown in FIGS. 9 and 10 wherein the outer end portions 36 of pins 33 are received in slots 37 which extend inwardly into each rung 24 from the bottom surface 26 thereof. Walls 38 at the ends of slots 37 prevent pins 33 from moving axially. Slots 37 terminate at bearing areas 39 which bear on the ends 36 of the pins. The rungs or steps 24 are retained on the ends of the pins because the neck portion 40 (FIG. 9) of each slot is of smaller size than the diameters of the pins so as to provide a locking action therewith.

A rung-like base 41 (FIGS. 1, 3, 4, 5 and 6) is secured to the lower ends 16 of rails 15. In this respect, pins 42 (FIG. 6), which may be identical to pins 33, extend through holes 43 in opposite side walls 35 of rails 15. The outer ends 44 of pins 42 are received in slots 45 which extend inwardly into rung-like base 41 from upper surface 46 and terminate at bearing areas 47 which bear on pin ends 44. Walls 48 at the ends of slots 45 prevent pins 42 from moving axially. The neck portion 49 of each slot 45 is smaller than the diameter of the end portions 44 of the pins so that rung-like base 41 will be retained in assembled position with the lower ends 16 of the rails 15.

The lower ends 16 of rails 15 are received in holes 50 which extend inwardly into base 41 from upper surface 46, holes 50 being located in outer end portions 51 of rung-like base 41. Sides 52 of holes 50 are spaced from the sides 53 of rails 15 so that rung-like base 41 can pivot about the axes of pins 42 which are aligned with each other. The sides 35 of rails 15 bear against the adjacent sides 58 of holes 50.

The pivotal action of rung-like base 41 is desirable so that the lower side 54 can rest squarely on pool liner 55, thereby minimizing the tendency for sharp edges to cut into pool liner 55. In this regard also it is to be noted that bottom surface 54 is continuous, that is, hole 50 is a blind hole and thus there is more bearing surface on lower side 54. In addition, since rung-like base 41 is essentially hinged to rails 15 by pins 42, as weight is applied to rungs 24, the bottom portions 16 of rails 15 can pivot relative to rung-like base 41 so that the latter can maintain its optimum bearing relationship with pool bottom 12, thereby obviating the tendency to cut into pool liner 55.

The legs 19 are secured to pool deck 11 by passing through sleeve-like fittings 57 having a flange portion 59 which is secured to pool deck 11 by screws 60. Each leg 19 passes through sleeve-like portion 61 and through a hole 62 in deck 11. A bolt 63 passes through sleeve portion 61 and leg 19 to secure legs 19 against vertical movement.

As noted, above, the ladder 10 can be assembled rapidly and simply without the use of any tools, and when once mounted on the pool, its rung-like base 41 will pivot to its best bearing relationship with pool bottom 12 and thus not dig into the pool liner.

While preferred embodiments of the present invention have been disclosed, it will be appreciated that it is not limited thereto but may be otherwise embodied within the scope of the following claims.

What is claimed is:

1. A ladder comprising a pair of spaced rails, a plurality of spaced rungs each having a central portion and integral opposite end portions and upper and lower sides, holes extending through said end portions and through said upper and lower sides for receiving said rail, pins extending through said rails and having outer end portions extending beyond said rails, and slot means in said rungs extending outwardly from opposite sides of each of said holes and extending inwardly into said rungs from said lower sides on opposite sides of each of said holes and terminating at bearing areas within said rungs for receiving said outer end portions of said pins with said bearing areas bearing on said outer end portions of said pins.

2. A ladder as set forth in claim 1 wherein said rungs have longitudinal axes, and wherein said pins extend in the directions of said longitudinal axes.

3. A ladder as set forth in claim 1 wherein said holes are of substantially mating configuration with said rails.

4. A ladder as set forth in claim 1 wherein said rails have lower ends, a pivotal rung-like base having a longitudinal axis and opposite end portions and upper and lower sides, second holes on said opposite end portions of said rung-like base, second pins having longitudinal axes extending through said lower ends of said rails in the direction of said longitudinal axis of said rung-like base and having outer end portions extending beyond said rails, and second slot means in said rung-like base extending outwardly from opposite sides of each of said second holes and extending inwardly into said rung-like base from said upper side thereof on opposite sides of each of said holes and terminating at second bearing areas within said rung-like base for receiving said outer end portions of said second pins with said pins bearing on said second bearing areas.

5. A ladder as set forth in claim 4 wherein said second holes are oversize relative to said lower ends of said rails to permit said rung-like base to pivot about said second pins.

6. A ladder as set forth in claim 4 wherein said second holes are blind holes.

7. A ladder as set forth in claim 6 wherein said rails have upper ends, resilient return bends at said upper ends, downwardly extending legs extending from said return bends, and rail struts between said upper ends of said rails and said downwardly extending legs, said rail struts flexing said downwardly extending legs outwardly away from said upper ends of said rails.

8. A ladder as set forth in claim 1 wherein said rails have upper ends, resilient return bends at said upper ends, downwardly extending legs secured to said return bends, and rail struts between said upper ends and said downwardly extending legs, said rail struts flexing said downwardly extending legs outwardly away from said upper ends of said rails.

9. A ladder comprising a pair of spaced rails having upper and lower ends, a plurality of rungs between said upper and lower ends, means mounting said rungs on said spaced rails, a rung-like base having a longitudinal axis and opposite end portions and upper and lower sides, holes in said opposite end portions, pins having longitudinal axes extending through said lower ends of said rails in the direction of said longitudinal axis and having outer end portions extending beyond said rails, slot means in said end portions of said rung-like base extending outwardly from opposite sides of each of said holes and extending inwardly into said rung-like base from said upper side thereof on opposite sides of each of said holes and terminating at bearing areas within said rung-like base for receiving said outer end portions of said pins with said pins bearing on said bearing areas.

10. A ladder as set forth in claim 9 wherein said holes are oversize relative to said lower ends of said rails to permit said rung-like base about said longitudinal axes of said pins.

11. A ladder as set forth in claim 9 wherein said holes are blind holes.

12. A ladder as set forth in claim 1 wherein said slot means include neck portions between said bearing surfaces and said lower surface which are of smaller size than the diameter of said pins so as to provide a locking action therewith.

13. A ladder as set forth in claim 4 wherein said slot means include neck portions between said bearing surfaces and said lower surface which are of smaller size than the diameter of said pins so as to provide a locking action therewith.

* * * * *